US006978579B1

(12) United States Patent
Trinca

(10) Patent No.: US 6,978,579 B1
(45) Date of Patent: Dec. 27, 2005

(54) STORM SHUTTER SYSTEM

(76) Inventor: Leonard Patrick Trinca, 7F St., St. Augustine, FL (US) 32080

( * ) Notice: Subject to any disclaimer, the term of this patent is extended or adjusted under 35 U.S.C. 154(b) by 106 days.

(21) Appl. No.: 10/659,671

(22) Filed: Sep. 11, 2003

(51) Int. Cl.[7] ..... E06B 3/28

(52) U.S. Cl. ..... 52/203; 52/208; 52/202; 52/476; 52/456; 49/50

(58) Field of Search ..... 52/203, 208, 212, 52/204.54, 204.71, 204.597, 483.1, 204.67, 52/476, DIG. 13, 204.5, 127.2, 202, 456; 49/57, 463, 466, 50

(56) References Cited

U.S. PATENT DOCUMENTS

| | | | | | |
|---|---|---|---|---|---|
| 2,777,174 | A | * | 1/1957 | Carr | 49/465 |
| 4,203,256 | A | * | 5/1980 | Mowry | 49/465 |
| 4,221,091 | A | * | 9/1980 | Ganse et al. | 52/202 |
| 4,384,436 | A | * | 5/1983 | Green | 52/202 |
| 4,467,574 | A | * | 8/1984 | Falge et al. | 52/106 |
| 4,562,666 | A | * | 1/1986 | Young, III | 49/62 |
| 4,726,149 | A | * | 2/1988 | Tryba | 49/465 |
| 5,335,452 | A | * | 8/1994 | Taylor | 49/463 |
| 5,383,315 | A | * | 1/1995 | Birs | 52/202 |
| 5,388,352 | A | * | 2/1995 | Ralph | 38/102.1 |
| 5,430,982 | A | * | 7/1995 | Bane | 52/202 |
| 5,457,921 | A | * | 10/1995 | Kostrzecha | 52/202 |
| 5,465,537 | A | | 11/1995 | Fullwood | |
| 5,487,244 | A | * | 1/1996 | Hill | 52/202 |
| 5,507,118 | A | * | 4/1996 | Brown | 49/61 |
| 5,540,018 | A | * | 7/1996 | Biggers | 52/202 |
| 5,596,849 | A | * | 1/1997 | Hill | 52/202 |
| 5,603,190 | A | * | 2/1997 | Sanford | 52/202 |
| 5,620,037 | A | * | 4/1997 | Apostolo | 160/118 |
| 5,623,791 | A | * | 4/1997 | Schwarz | 52/107 |
| 5,722,206 | A | * | 3/1998 | McDonald | 52/202 |
| 5,740,639 | A | * | 4/1998 | Covington | 52/202 |
| 5,911,660 | A | * | 6/1999 | Watson | 52/202 |
| 5,918,430 | A | * | 7/1999 | Rowland | 52/202 |
| 5,921,056 | A | * | 7/1999 | Weiss et al. | 52/745.16 |
| 5,941,031 | A | * | 8/1999 | Fullwood | 52/202 |
| 5,996,292 | A | * | 12/1999 | Hill et al. | 52/202 |
| 6,079,168 | A | * | 6/2000 | Shaver | 52/202 |
| 6,219,978 | B1 | * | 4/2001 | Wood | 52/202 |
| 6,269,597 | B1 | * | 8/2001 | Haas | 52/203 |
| 6,330,768 | B1 | * | 12/2001 | Rodrigues | 52/202 |
| 6,371,422 | B1 | | 4/2002 | St. Martin | |
| 6,393,777 | B1 | | 5/2002 | Renfrow | |
| 6,708,457 | B1 | * | 3/2004 | Ballough | 52/202 |
| 6,745,522 | B2 | * | 6/2004 | Germain | 52/202 |
| 6,910,312 | B2 | * | 6/2005 | Whitworth | 52/741.3 |

* cited by examiner

*Primary Examiner*—Carl D. Friedman
*Assistant Examiner*—Chi Q. Nguyen
(74) *Attorney, Agent, or Firm*—Lawrence J Gibney, Jr.

(57) ABSTRACT

The embodiment of this invention is disclosed, which describes a storm shutter system, which allows easy installation and removal by the homeowner. This invention does not add anything to the window and does not require the homeowner to change the window or drill holes into the home in order to install this device. The device is installed in a temporary fashion using the existing screen track of the existing window. One side of the device used a bar, which remains, in a fixed position and the other side uses a bar with slots to allow lateral movement to insure custom fit of the device.

3 Claims, 4 Drawing Sheets

STORM SHUTTER SYSTEM

CROSS REFERENCES TO RELATED APPLICATIONS

None

STATEMENT REGARDING FEDERALLY SPONSORED RESEARCH

No federal research money was used in the development of this invention.

REFERENCE TO APPENDIX

No appendix accompanies this application

BACKGROUND OF THE INVENTION

A person's largest investment during a lifetime is usually his or her home. Great care is taken to select the location of the home, the layout of the home and the parts to a home. Because of this concern the homeowner spends many hours and much money maintaining and beautifying his or her home.

The present invention is used to protect windows of a home or a business during periods of inclement weather by using the screen track of the existing window in the home. In the construction of homes or businesses windows are an integral part of the construction. Most of the windows are equipped with screens. The purpose of the screen is to allow the owner to open the window and prevent the entry of foreign objects.

The window with a screen is either a half screen or a full screen. The choice of whether to have a full or half screen is made by the property owner. Regardless of the choice the screen will fit securely within the screen track. This allows the screen to remain in place during normal operation of the window. This device takes advantage of this existing track. The present device does not require modification of the existing window or window frame. It also does not require any modification to the existing exterior structure of the building. Another advantage of this device is the ease of installation and removal as well as the relatively low cost to the homeowner. Additionally, this is not a permanent addition to the home and the device itself can be made aesthetically pleasing for the homeowner.

In the half screen window the invention, which is installed on the outside of the building, is inserted into the screen track. The device has two separate bars on opposite sides of the device to enable a secure fit within the screen track. One bar, which is mounted permanently to one side of the device, would give sufficient width and length to cover approximately 80% to 90% of the existing screen track. On the opposite end but on the same side of the permanent mounted side is an identical bar. Slots are provided to adjust the "fit" of the device to the window and tighten the device to the window for a secure fit.

In the full screen window, the device would extend from the top of the window to the bottom of the window. In the half screen window the device would only extend the length of the screen track. In the half screen window molding would be installed to make it aesthetically pleasing for the homeowner. The molding would cover the entire window. The central idea however, would not be changed by the addition of the molding for any particular installation. If molding is used it would extend the full length of the window frame and attach to the outside of the window frame through the use of epoxy or screws.

In the case of the half screen the clamping device would be inserted into the existing screen track of the window and the molding would cover the remainder of the outside of the window. The molding would rest against the window frame of the existing window and cover the entire window surface. In this example the lower half of the device would use the screen track for the bottom half of the invention and the upper part of the device would rest flush against the window frame. The upper part would be secured to the window frame by epoxy or screws.

In the window that has a full screen the device would be installed in the screen track and be "clamped" on the existing frame. In this example no epoxy or screws would be necessary. This device could also be used on any type window (bay, casement, half screen, or full screen) in use today. The choice of material that is used to form the barrier between the weather and the window could be a variety of material including hard plastic, polycarbonate or laminates to name just a few. An advantage to this device is the easy installation using the existing fit of the window to install this device. It is not altering, in any way, the window nor does the homeowner have to drill or anchor this particular device to the brick stucco or wood on the outside of the home.

Untightening the fastening devices and sliding the bar over accomplishes the removal of the device.

The choice of material in manufacturing this particular device will depend upon the specific location. It must be able to withstand high force winds and objects, which may strike the outside of the device. The choice of material is not significant other than the fact that it must be durable and resistant to inclement weather.

BRIEF SUMMARY OF THE INVENTION

This device uses the existing screen track of a window and two bars, which can be tightened so that the fit of the window is secure against the window. Because it uses the existing equipment of the window modifications do not need to be made to the window. It does not alter the window nor does it detract from the aesthetics of the home.

The device is not meant to be a permanent addition to the home but merely is installed or removed in the event of inclement weather.

It would be relatively easy to manufacture using existing products.

The invention itself contains a board, which has predrilled holes on one side and a bar on the opposite side of the predrilled holes. This is fastened with either bolts or wing nuts. This part of the invention is permanently fixed in one position.

On the opposite side of the device is an identical bar. It is also attached in the same manner. However, on this side slots have been added. These slots allow the bar to move in a lateral or side-to-side fashion from one side to the other at a distance of approximately three inches. The slots will allow the user to "custom fit" the device to an existing window. The slots also insure that the fit will be a secure fit.

The device itself will be custom fit to the window and will be tightened according to tightening bolts or wing nuts on the side with the slots.

In the event that a half screen window is involved molding, which would be attached to the device, is also added to protect the window while using only the half screen. This molding would cover the part of the window that could not be covered by the window with the half screen track and is attached to the existing window frame using epoxy or screws.

In the event that the window has a full screen the device would extend the entire length of the window. In this case no molding would be used and no attachment to the outside of the window frame would be necessary.

The device could be used on any type window and would be easy to install and remove. The choice of materials would depend on a particular manufacturer and their preference. The requirements for the choice of materials are durability and strength.

BRIEF DESCRIPTION OF THE DRAWINGS

The invention is further described in the accompanying drawings.

DETAILED DESCRIPTION

Figure 1:
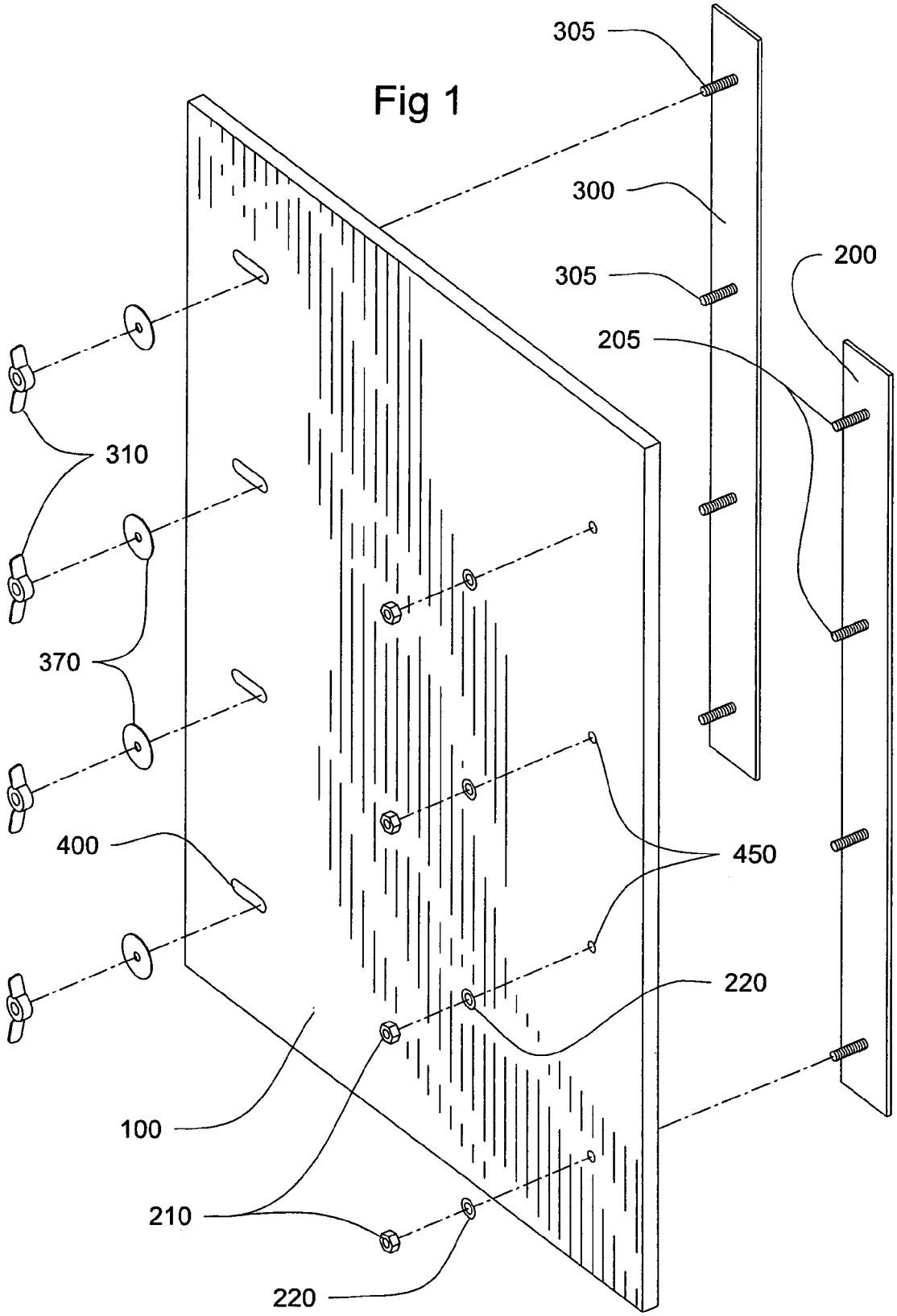
FIG. 1 is an exploded view of the invention.

This invention is a piece of plywood, formica or other hard surface (100). As depicted in FIG. 1, the device has two bars (200, 300), which are identical but are placed on opposite sides of the device, near the outside edges of the device. One of the bars (200) is inserted through a series of holes and is attached with washers and nuts. This side of the device will remain fixed in position as the invention is used.

Figure 6:
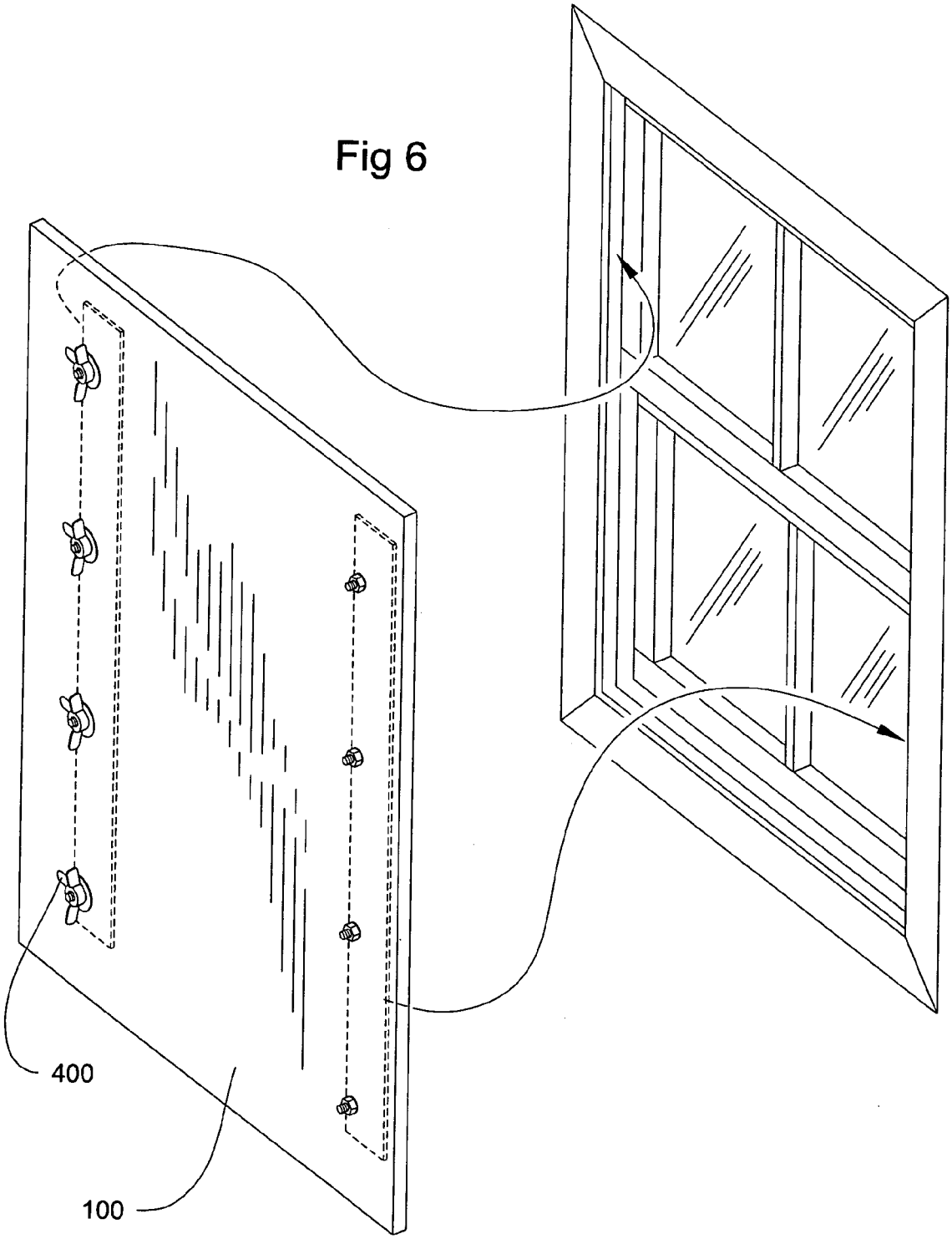
FIG. 6 is a perspective view of the invention and indicates how the invention will be installed in a window.

The other bar (300) slides from side to side by use of predrilled slots. The slots (400) have been installed so that this bar can move laterally along the surface of the device. The washers and wing nuts help attach this particular bar to the device. The wing nuts allow the bar to be moved from side to side to accommodate particular windows. As depicted in FIG. 1, the bars are of identical length and are made either of aluminum or stainless steel or other similar durable material. The choice of material in constructing the invention is not relevant, except to the extent that they must be able to withstand high force winds and objects being thrown into them in order to protect the window. According to FIG. 6, the device (200, 300)is placed within a screen track of a window. It is anticipated that this device will completely cover the window once it is properly installed on a full track screen window. On a half-track screen window it is anticipated that this device will cover one half and there will be additional molding, which is attached to cover the additional one half of the window.

Again, choice of material is not important, expect to the extent that it must be durable enough to withstand high winds and/or objects being thrown onto the surface.

Figure 2:
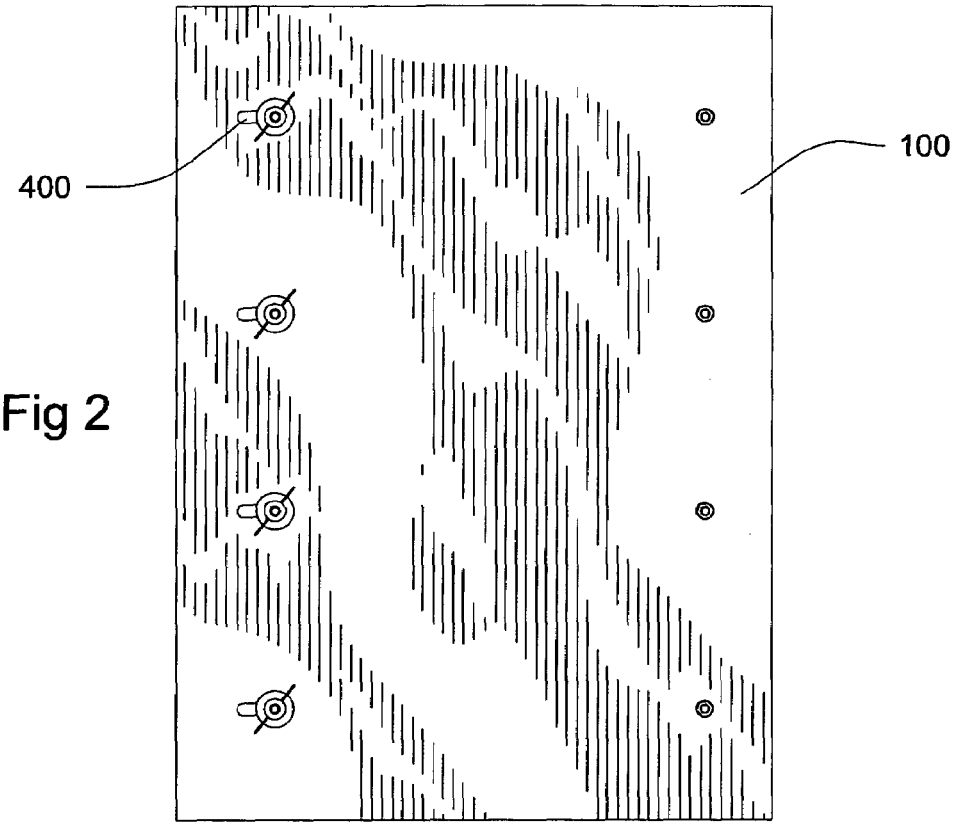
FIG. 2 is a front view of the invention.
Figure 3:
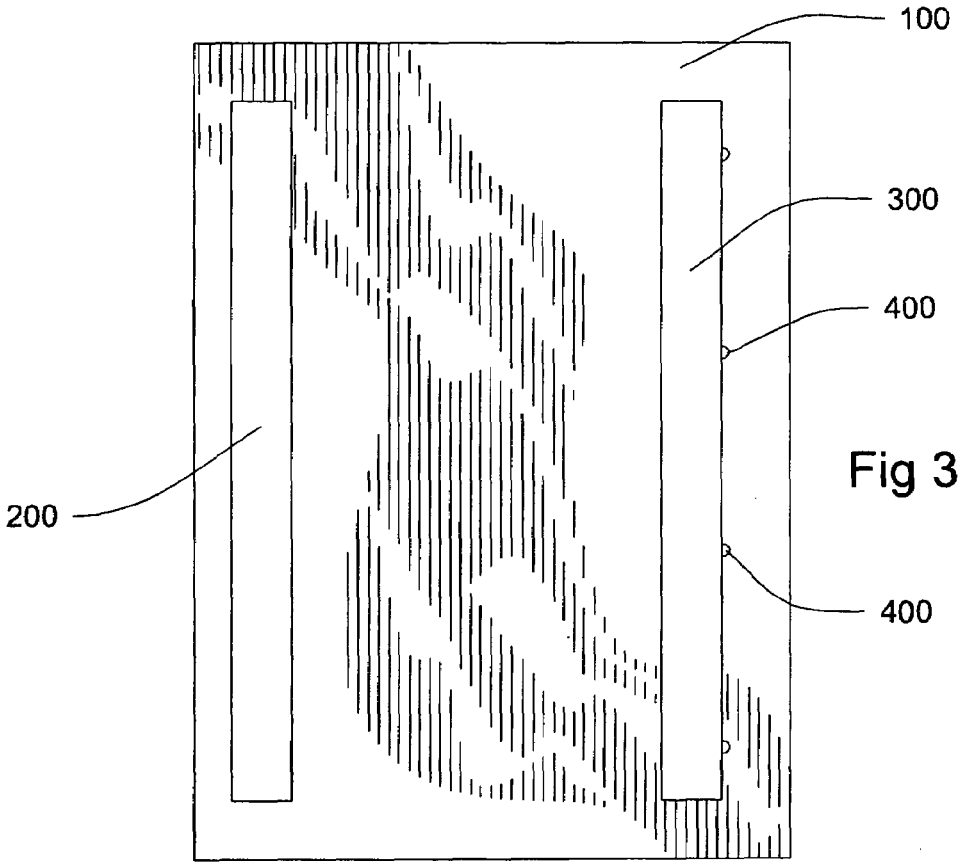
FIG. 3 is a back view of the invention.
Figures 4, 5:
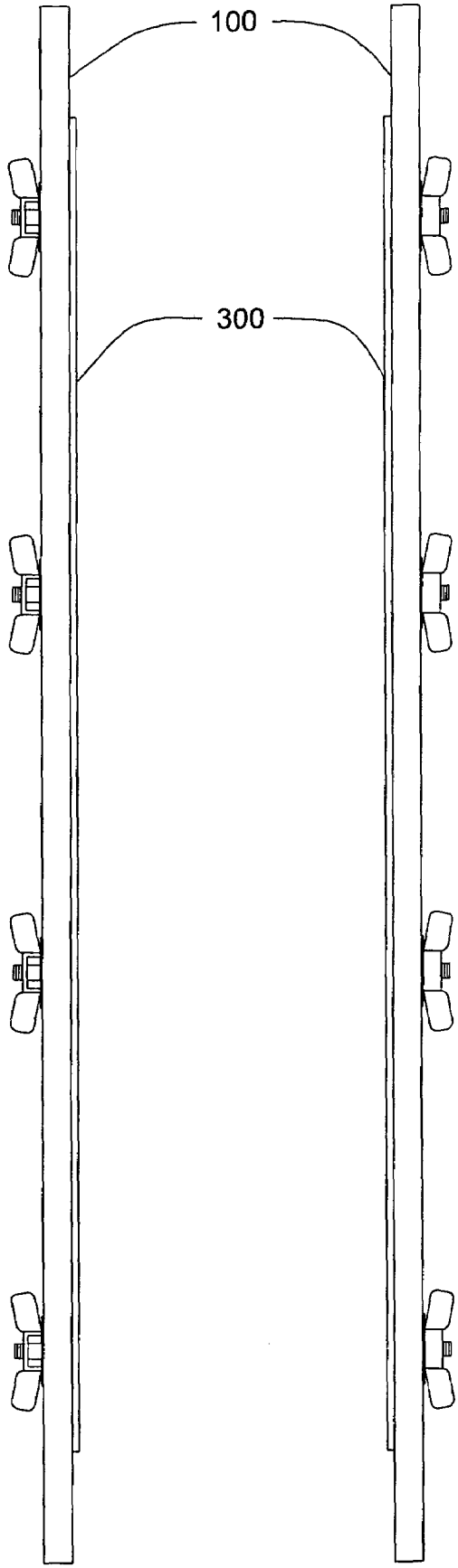
FIG. 4 is a right side view of the invention.
FIG. 5 is a left side view of the invention.

Wing nuts have been installed on the device as depicted in FIG. 2, to be able to loosen the bar to be able to slide it from side to side as the device is used.

What is claimed is:

1. A device to protect windows from storm damage which is comprised of the following:

a. a panel;

wherein the panel is of a predetermined size to cover a window;

b. two solid bars;

wherein the bars are placed on the same side of the panel;

wherein both of the bars are secured to the panel with a means of connection;

wherein the bars are rigid;

wherein the bars are equipped with a piece of threaded stock, which extends vertically from the rigid bar;

wherein the first bar is secured to the panel and fixed in position;

wherein the second bar is secured to the panel but allowed to move laterally from side to side a predetermined distance within a slot provided for that purpose;

c. two rows of holes;

wherein one set of holes allows no lateral movement of the bar;

wherein the other set of holes allows lateral movement of the bar;

wherein one edge of the first and second bar is placed within a screen track;

d. means of connection;

wherein the means of connection for one bar is a washer and nut;

wherein the means of connection for one bar is a washer and wing nut;

wherein the device is secured to the screen track by inserting the respective edges of the rigid bars into the screen tracks and tightening the means of connection.

2. "The device as described in claim 1, wherein the two solid bars are equal in length".

3. The device as described in claim 1 can be used in a full screen track window.

* * * * *